US007930984B2

(12) United States Patent
Lawrence

(10) Patent No.: US 7,930,984 B2
(45) Date of Patent: Apr. 26, 2011

(54) BODY SHAPING WEAR

(76) Inventor: Yi-Ping Lawrence, Woodsetton (GB)

( * ) Notice: Subject to any disclaimer, the term of this patent is extended or adjusted under 35 U.S.C. 154(b) by 1325 days.

(21) Appl. No.: 11/428,397

(22) Filed: Jul. 2, 2006

(65) Prior Publication Data

US 2008/0010714 A1 Jan. 17, 2008

(51) Int. Cl.
*D05B 23/00* (2006.01)
*A41D 7/00* (2006.01)

(52) U.S. Cl. ..... 112/475.09; 2/243.1

(58) Field of Classification Search ..... 2/243.1, 2/275; 428/32.16, 102, 113; 28/169; 112/475.01, 112/475.08, 475.09, 441, 413
See application file for complete search history.

(56) References Cited

U.S. PATENT DOCUMENTS

| | | | | |
|---|---|---|---|---|
| 4,916,755 | A * | 4/1990 | Feigenbaum et al. | 2/67 |
| 6,638,319 | B2 * | 10/2003 | Sanduja et al. | 8/115.55 |
| 2003/0166369 | A1 * | 9/2003 | De Leon et al. | 442/327 |
| 2004/0040640 | A1 * | 3/2004 | Bordes | 156/73.5 |
| 2004/0053001 | A1 * | 3/2004 | Abrams | 428/90 |

* cited by examiner

*Primary Examiner* — Ismael Izaguirre

(57) ABSTRACT

A body-shaping wear is disclosed. The body-shaping wear is produced by a process including a step of softening a fabric. The fabric has a thickness of about 280 to about 600 den. About 22 to about 56 percent of the fabric is made of a synthetic and elastic fiber.

2 Claims, 9 Drawing Sheets

BODY SHAPING WEAR

BACKGROUND OF THE INVENTION

1. Field of Invention

This invention relates generally to a piece of cloth, and more particularly to a body-shaping wear fabricated of the piece of cloth.

2. Description of Related Art

Clothing industry is an industry in which products are developed extremely fast. Any change or choice may generate an unexpected result, or even overcome a technical prejudice existing for a long time. This change or choice should not be evaluated by hindsight. Accordingly, this inventor studies in the industry, and provides a piece of printed cloth and a body-shaping wear as follows.

SUMMARY OF THE INVENTION

A piece of printed cloth may be produced by a process. The process includes a step of softening a fabric. The fabric may have a thickness of about 280 to about 600 den. Preferably, about 22 to about 56 percent of the fabric is made of a synthetic and elastic fiber. The piece of the printed cloth is for producing a body-shaping wear.

DETAILED DESCRIPTION OF THE INVENTION

Figure 1:
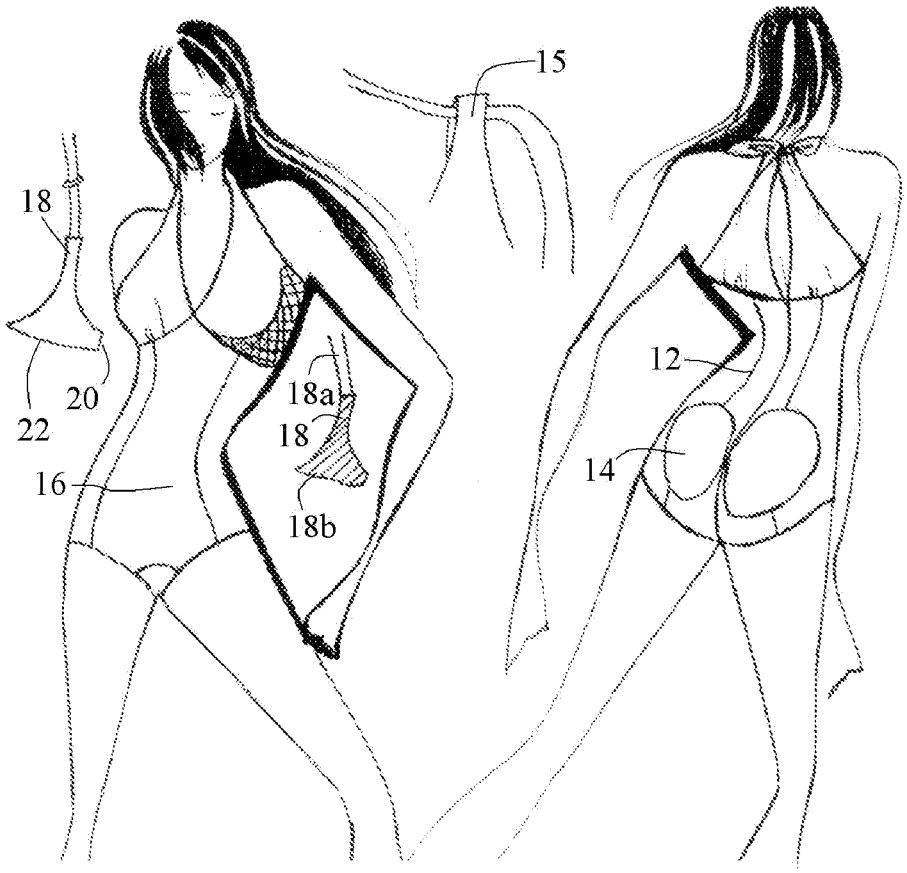
FIG. 1 is a diagram illustrates a fashion wear according to a first embodiment of the present invention.

FIG. 1 is a diagram illustrates a fashion wear according to a first embodiment of the present invention. Referring to FIG. 1, the wear appears fashion, and not stereotypical or unwieldy. After wearing the wear, one may immediately have a perfect body curve. Before the wear is made, a golden ratio of a person's body is outlined by a professional. According to the golden ratio and kinesiology, the wear is made by three-dimensionally forming and combining plates. This wear may be designed and functioned to effectively contract a relaxing abdomen, to sculpture a waist, and to centralize a chest.

The above fashion wear may be a body-shaping wear. The body-shaping wear is different from a conventional body-shaping wear. A conventional body-shaping wear is often stereotypical and unwieldy and is without popular feeling. Such body-shaping wear is not welcome, so it is usually made to be an underwear rather than an outerwear. Even one wears such underwear, however, he or she may sometimes feel embarrassed and awkward, when he or she faces to an intimate person.

The fashion wear, according to the first embodiment of the present invention, may have no above conventional disadvantages. Therefore, the fashion wear may be made not only to be a body-shaping wear, but also to be an outerwear or swimming wear. The body-shaping wear may be made to have a golden ratio, to be without a bra, to be without a crotch. The body-shaping wear may be for a male person.

The fashion wear of the first embodiment may have a high elasticity coefficient. Compared to a conventional body-shaping wear, the fashion wear of the first embodiment may shape one's body in an efficient way. Moreover, the fashion wear may prevent one's body curve from being changed. Furthermore, the fashion wear may prevent one from eating too much or from relaxing his or her pelvis.

Figure 2:
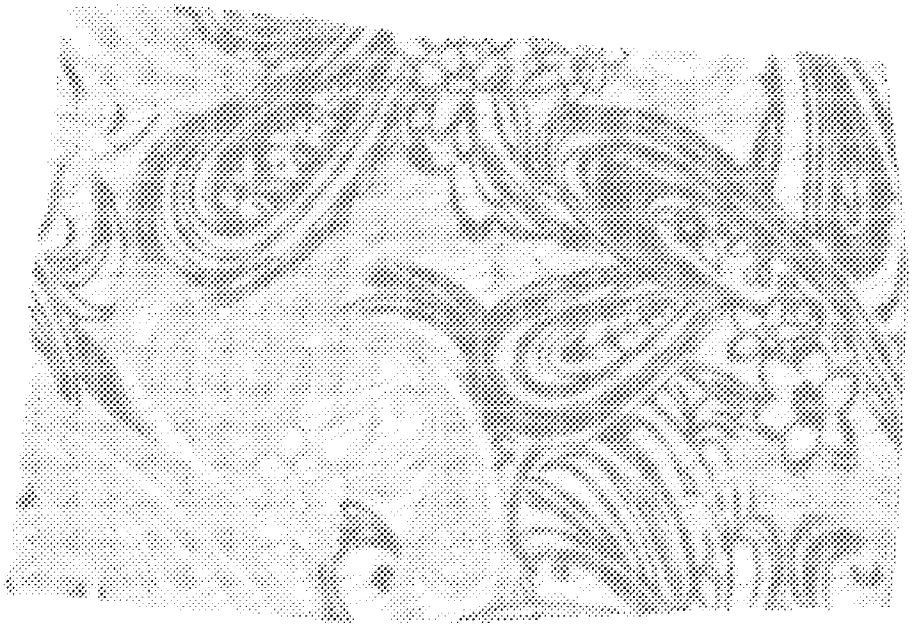
FIG. 2 schematically shows a piece of printed cloth according to a first embodiment of the present invention.
Figure 3:
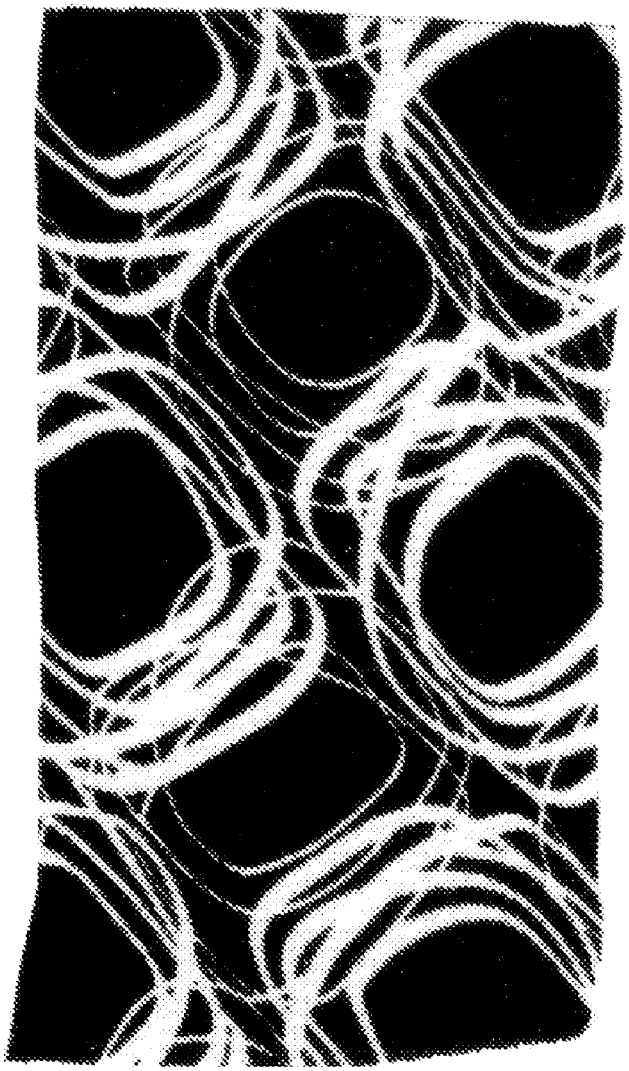
FIG. 3 schematically shows another piece of printed cloth according to a first embodiment of the present invention.

The fashion wear may be produced by at least sewing a fabric. The fabric may be sewn by using a silk yarn. The fabric, for example, is shown in FIG. 2 or FIG. 3. FIG. 2 schematically shows a piece of printed cloth according to a first embodiment of the present invention. Referring to FIG. 2, the piece of printed cloth may be produced by a process. The process may include a softening step and a dyeing step. The fabric may have a thickness of about 280 to about 600 den. About 22 to about 56 percent of the fabric may be made of a synthetic and elastic fiber. The fabric is softened in the softening step. The fabric is dyed by a printing technique in the dyeing step. The sequence of the steps, merely for example, does not limit the scope of this invention.

The synthetic and elastic fiber may be lycra. Preferably, about 22 to about 56 percent of the fabric may be made of lycra®/spandex. The fabric, with a thickness of about 280 to about 600 den, has a high elasticity coefficient. This fabric effectively shapes one's body. A fashion wear made of this fabric prevents one's body curve from being changed. Furthermore, the fashion wear may prevent one from eating too much or from relaxing his or her pelvis. This fabric is very elastic, so that it is sewn by using a silk yarn preferably.

The right part of FIG. 1 schematically shows a back of a fashion wear of the first embodiment. The back of the fashion wear is chiefly made of two pieces of printed clothes of the first embodiment, as reference number 12. The buttocks part 14 of the fashion wear is preferably made of one piece of printed cloth of the first embodiment. The back of the fashion wear has an upper portion. On the upper portion, a plurality of buttons are formed. The buttons are for buckling, but can be untied.

The left part of FIG. 1 schematically shows a front of a fashion wear of the first embodiment. The front of the fashion wear has a central part 16. The central part 16 is preferably made of one piece of inelastic cloth and two pieces of printed clothes of the first embodiment. The front of the fashion wear may further have a hip part 14. The hip part 14 is preferably made of one piece of the printed cloth of the first embodiment. The front of the fashion wear may further have a bra 16. The bra may have an inner cloth 18 and an outer cloth. The outer cloth and the inner cloth 18 may respectively be a piece of the printed cloth of the first embodiment. Preferably, the inner cloth 18 has an area substantially smaller than the area of the outer cloth. The inner cloth may include an adjusting shoulder strip 18*a* and a centralizing mean 18*b*. The centralizing mean 18 may have a siding line 20 and a high waistline 22.

The fashion wear of the first embodiment may have the following characteristics:

1. Design:

a. The fashion wear may shape one's body.

b. The fashion wear may have a golden ratio. The golden ratio is designed according to everyone's body by professionals.

c. The design is exquisite to perfectly express everyone's body, no matter his or her body is perfect or not.

d. The fashion wear is functioned to effectively contract a relaxing abdomen, to sculpture a waist, and to centralize a chest.

e. According to the golden ratio and kinesiology, the fashion wear is made by three-dimensionally forming and combining plates. After wearing the fashion wear, one's body may have a perfect curve immediately.

2. Cloth Processing:

a. A fabric, having excellent elasticity, may be used to fabricate a body-shaping wear. The piece of the cloth may be printed by dyeing a fabric.

b. After the fabric is printed, a printed cloth may be achieved to visually different from a non-printed cloth.

c. A piece of printed cloth is popular and fashion, and is thus different from a conventionally stereotypical and unwieldy elastic cloth. One reason for the difference may be that the above-mentioned fabric is softened.

3. Fabrication:

This cloth of the first embodiment has a high elasticity. Such high-elasticity cloth may be fabricated by using a silk yarn to sew the fabric of the first embodiment.

Figure 4:
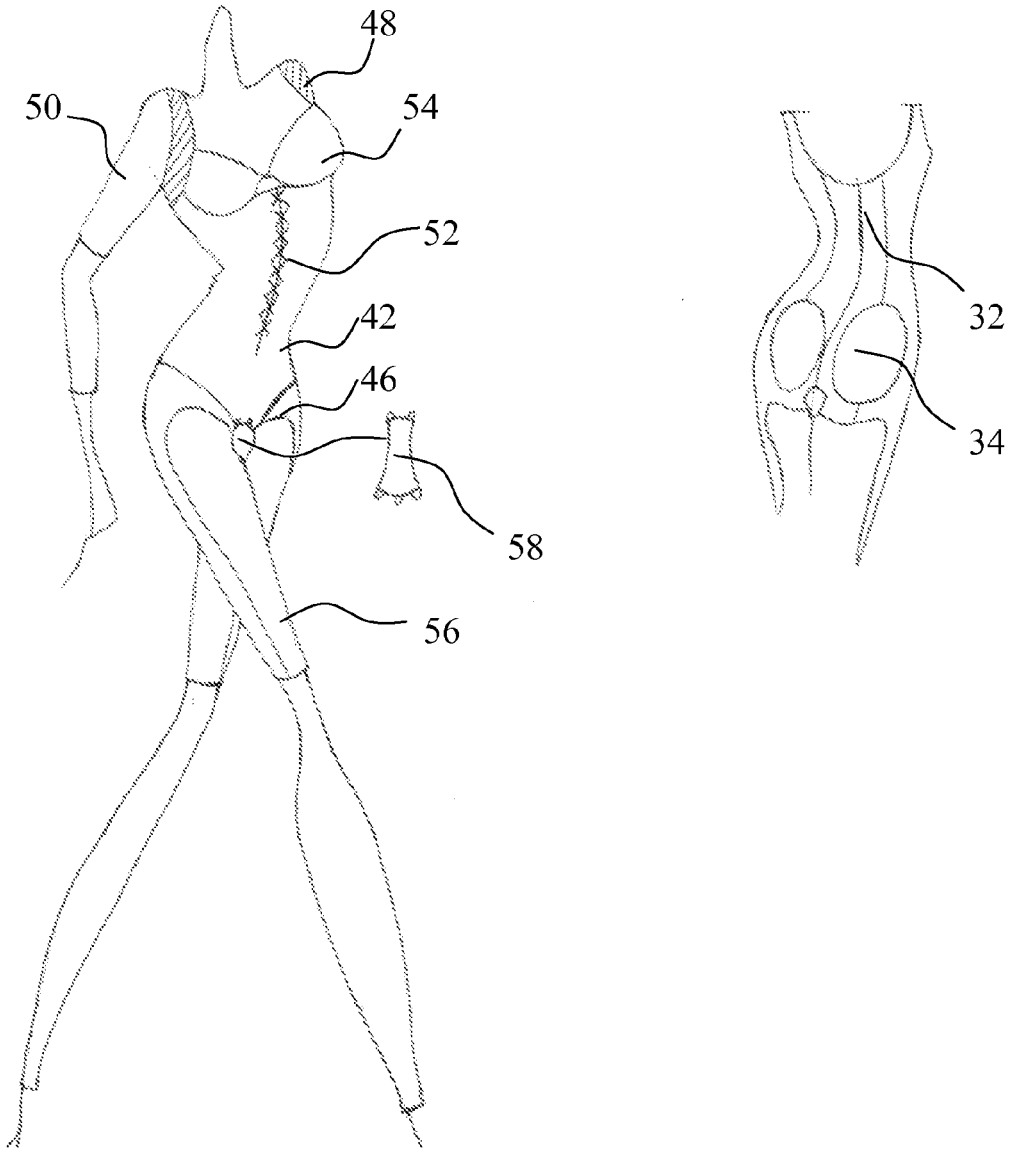
FIG. 4 is a diagram illustrates a fashion wear according to a second embodiment of the present invention.

FIG. 4 is a diagram illustrates a fashion wear according to a second embodiment of the present invention. Referring to FIG. 4, the wear appears fashion, and not stereotypical or unwieldy. After wearing the wear, one may immediately have a perfect body curve. Before the wear is made, a golden ratio of a person's body is outlined by a professional. According to the golden ratio and kinesiology, the wear is made by three-dimensionally forming and combining plates. This wear may be designed and functioned to effectively contract a relaxing abdomen, to sculpture a waist, and to centralize a chest.

Figure 5:
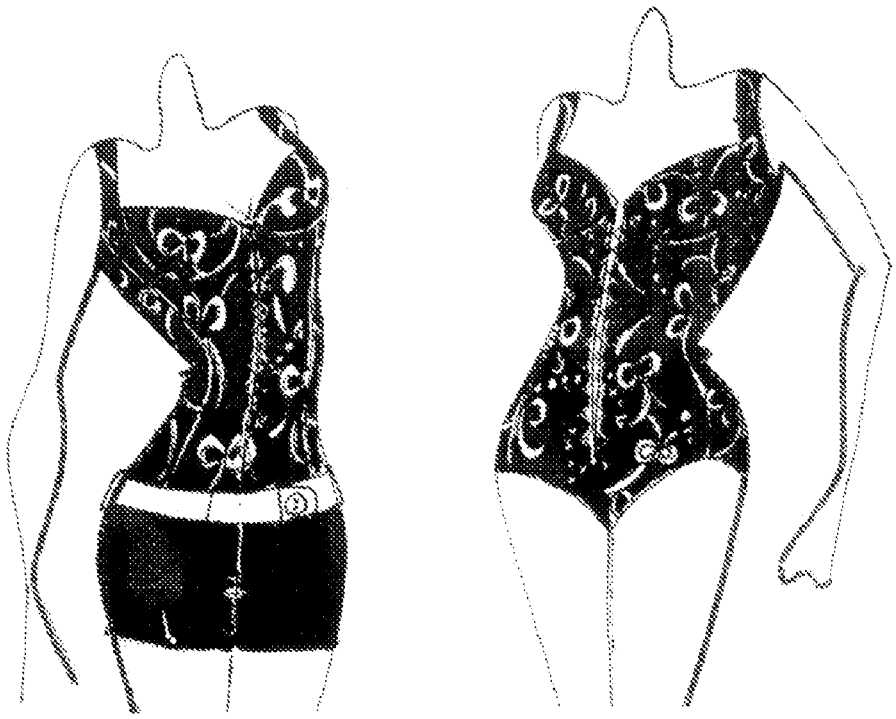
FIG. 5 schematically shows a fashion body-shaping wear according to a third embodiment of the present invention.

The above fashion wear may be an outerwear, as shown in FIG. 5. The outerwear is different from a conventional underwear. The right part of FIG. 5 schematically shows a fashion body-shaping wear according to a third embodiment of the present invention. If one wears a skirt after wearing the above body-shaping wear, the body-shaping wear may serve as an outer wear.

Referring to FIG. 4, the fashion wear may be a swimming wear. The swimming wear is different from a conventional swimming wear. A conventional swimming wear is not functioned to shape one's body curve. Therefore, such a conventional swimming wear is not popular, especially to one who thinks that he or she has a bad body curve.

The swimming wear of the second embodiment may have no above disadvantages. Because a golden ratio of a male or female person's body is outlined by a professional, before the swimming wear is made. The swimming wear is made according to the golden ratio, so that it is functioned to shape one's body. Such swimming wear is popular even to one who thinks that he or she has a bad body curve. The swimming wear makes one feel confident, because he or she looks like to have a perfect body curve after wearing the swimming wear.

The swimming wear or the outerwear of the second embodiment may have a high elasticity coefficient. Compared to a conventional body-shaping wear, the swimming wear or the outerwear may shape one's body in an efficient way. Moreover, the swimming wear or the outerwear may prevent one's body curve from being changed. Furthermore, the swimming wear or the outerwear may prevent one from eating too much or from relaxing his or her pelvis.

Figure 6:
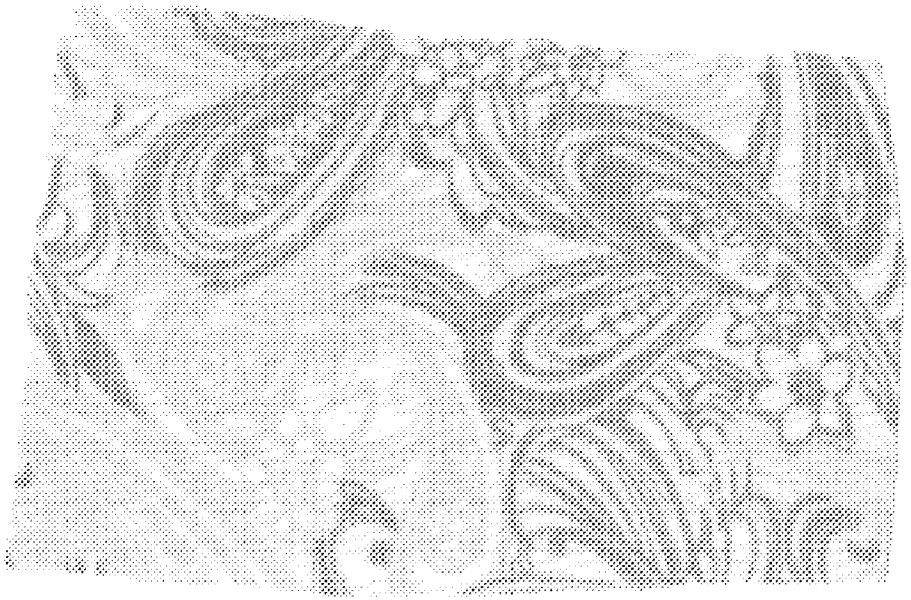
FIG. 6 schematically shows a piece of printed cloth according to a second embodiment of the present invention.
Figure 7:
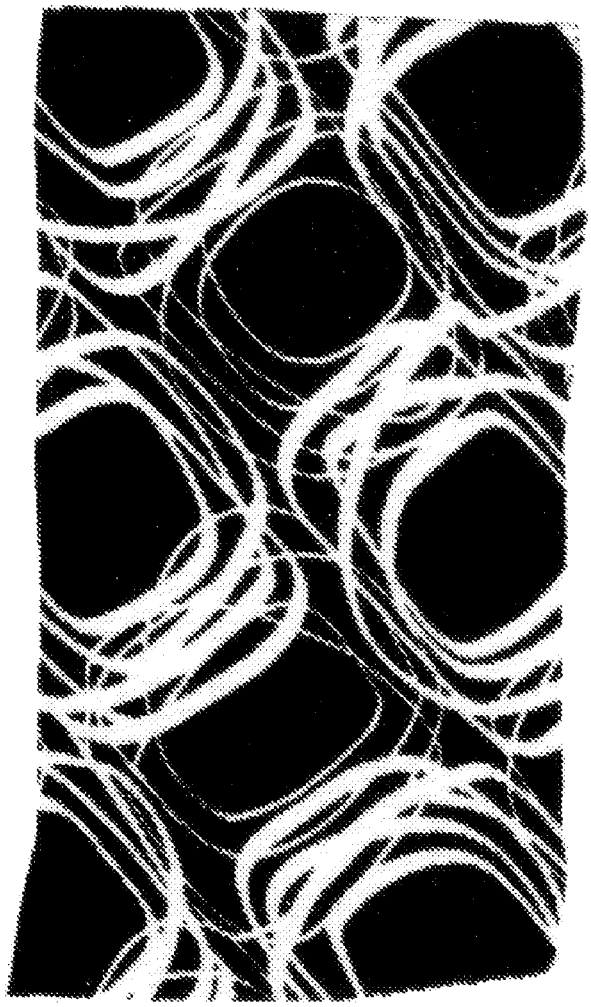
FIG. 7 schematically shows another piece of printed cloth according to a second embodiment of the present invention.

The swimming wear may be produced by at least sewing a fabric. The fabric may be sewn by using a silk yarn. The fabric, for example, is shown in FIG. 6 or FIG. 7. FIG. 6 schematically shows a piece of printed cloth according to a second embodiment of the present invention. Referring to FIG. 6, the piece of printed cloth may be produced by a process. The process may include a softening step and a dyeing step. The fabric may have a thickness of about 280 to about 600 den. About 22 to about 56 percent of the fabric may be made of a synthetic and elastic fiber. The fabric is softened in the softening step. The fabric is dyed by a printing technique in the dyeing step. The sequence of the steps, merely for example, does not limit the scope of this invention.

The synthetic and elastic fiber may be lycra. Preferably, about 22 to about 56 percent of the fabric may be made of lycra®/spandex. The fabric, with a thickness of about 280 to about 600 den, has a high elasticity coefficient. This fabric effectively shapes one's body. A fashion wear made of this fabric prevents one's body curve from being changed. Furthermore, the fashion wear may prevent one from eating too much or from relaxing his or her pelvis. This fabric is very elastic, so that it is sewn by using a silk yarn preferably.

The right part of FIG. 4 schematically shows a back of a fashion wear of the second embodiment. The back of the fashion wear is chiefly made of two pieces of printed clothes of the first embodiment, as reference number 32. The Buttocks part 34 of the fashion wear is preferably made of one piece of printed cloth of the first embodiment. The back of the fashion wear has an upper portion. On the upper portion, a plurality of buttons are formed. The buttons are for buckling, but can be untied.

The left part of FIG. 4 schematically shows a front of a fashion wear of the second embodiment. The front of the fashion wear is made of two pieces of printed clothes of the second embodiment, except for the bra of the fashion wear. An enhancing cloth 46 is formed between the wear and the outside of one's thighs. The enhancing cloth 46 may locally shape one's body curve.

The wear may have two shoulder straps 48 composed of sandwich clothes. The wear may have a portion covering upper arms 50. The portion of the wear may be long sleeves or short sleeves. The wear may alternatively have no sleeve. The front of the wear may have an opening 52 in the middle. The opening may alternatively be formed on the sides of the front of the wear. The opening 52 may be covered with a plurality of eyelets, zips or dark buttons.

The wear may have a bra 54. The bra may be an adjustable bra or removable bra. The wear may further have an adjustable crotch 58. The upper portion of the adjustable crotch 58 may have two fasteners. The lower portion of the adjustable crotch 58 may have three fasteners. By using those fasteners, one may opening the crotch when he goes to the toilet. The wear may have a portion covering one's legs 56. The portion of the wear may be long or short. The portion of the wear may be alternatively formed as a pair of pants.

The swimming wear of the second embodiment is a body-shaping wear. The body-shaping wear may have the following characteristics:

1. Design:

a. The body-shaping wear may shape one's body.

b. The body-shaping wear may have a golden ratio. The golden ratio is designed according to everyone's body by professionals.

c. The design is exquisite to perfectly express everyone's body, no matter his or her body is perfect or not.

d. The body-shaping wear is functioned to effectively contract a relaxing abdomen, to sculpture a waist, and to centralize a chest.

e. According to the golden ratio and kinesiology, the body-shaping wear is made by three-dimensionally forming and combining plates. After wearing the body-shaping wear, one's body may have a perfect curve immediately.

2. Cloth Processing:

a. A fabric, having excellent elasticity, may be used to fabricate a body-shaping wear. The piece of the cloth may be printed by dyeing a fabric.

b. After the fabric is printed, a printed cloth may be achieved to visually different from a non-printed cloth.

c. A piece of printed cloth is popular and fashion, and is thus different from a conventionally stereotypical and unwieldy elastic cloth. One reason for the difference may be that the above-mentioned fabric is softened.

3. Fabrication:

This cloth of the first embodiment has a high elasticity. Such high-elasticity cloth may be fabricated by using a silk yarn to sew the fabric of the second embodiment.

The piece of printed cloth of the second embodiment may be for producing a female swimming wear, or alternatively a male swimming wear. The male swimming wear is, for example, as shown in FIG. 8.

Figure 8:
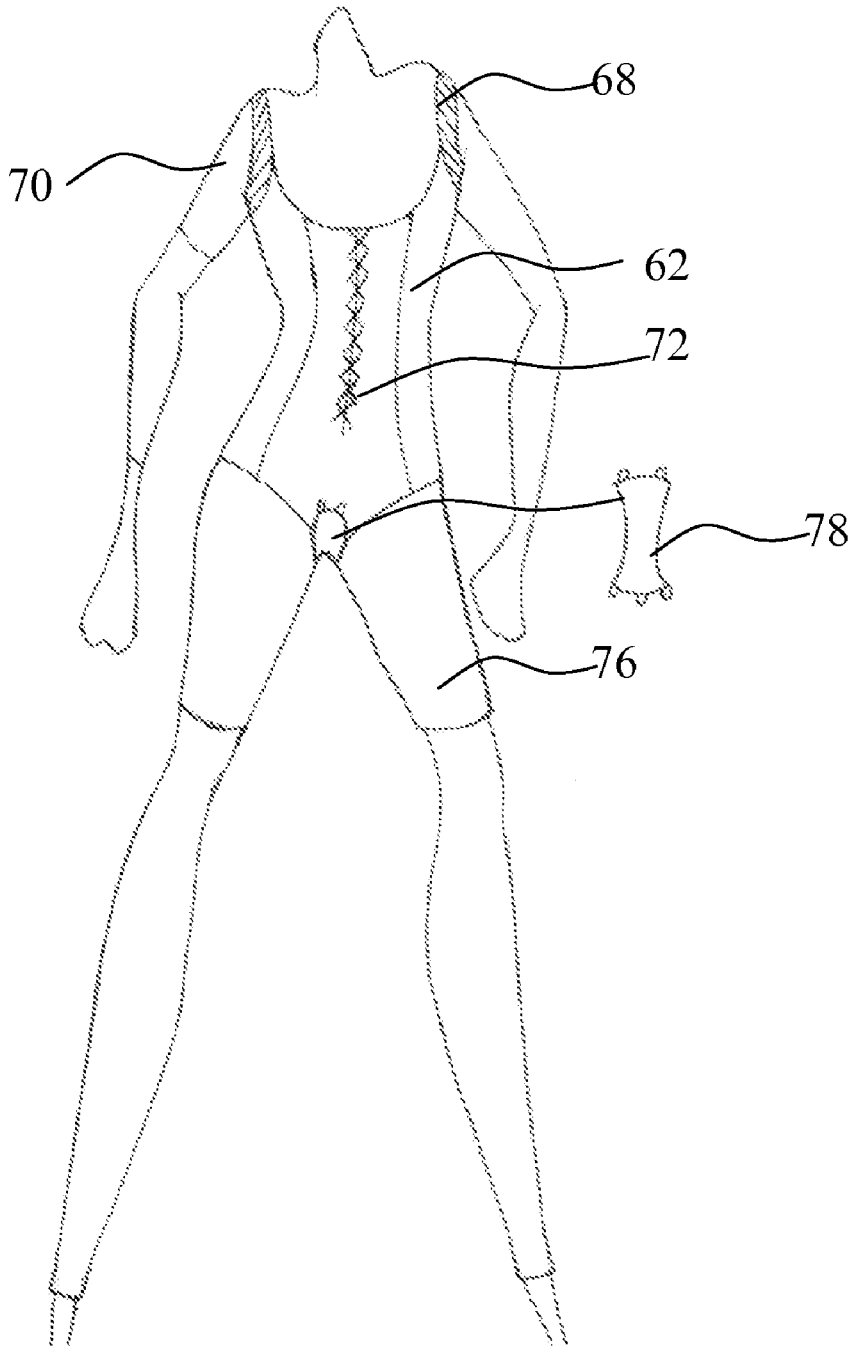
FIG. 8 is a diagram illustrates a male swimming wear according to a fourth embodiment of the present invention.

FIG. 8 is a diagram illustrates a male swimming wear according to a fourth embodiment of the present invention. The male swimming wear is chiefly made of two pieces of printed clothes of the second embodiment, as reference number 62. The male swimming wear may have two shoulder straps 68 composed of sandwich clothes. The male swimming wear may have a portion covering upper arms 70. The portion of the male swimming wear may be long sleeves or short sleeves. The male swimming wear may alternatively have no sleeve. The front of the male swimming wear may have an opening 72 in the middle. The opening may alternatively be formed on the sides of the front of the male swimming wear. The opening 72 may be covered with a plurality of eyelets, zips or dark buttons.

The male swimming wear may further have an adjustable crotch 78. The upper portion of the adjustable crotch 78 may have two fasteners. The lower portion of the adjustable crotch 78 may have three fasteners. By using those fasteners, one may opening the crotch when he goes to the toilet. The male swimming wear may have a portion covering one's legs 76. The portion of the male swimming wear may be long or short. The portion of the male swimming wear may be alternatively formed as a pair of pants.

In one aspect, the process for fabricating the swimming wear of the present invention is also a process for fabricating an outerwear of the present invention.

Figure 9:
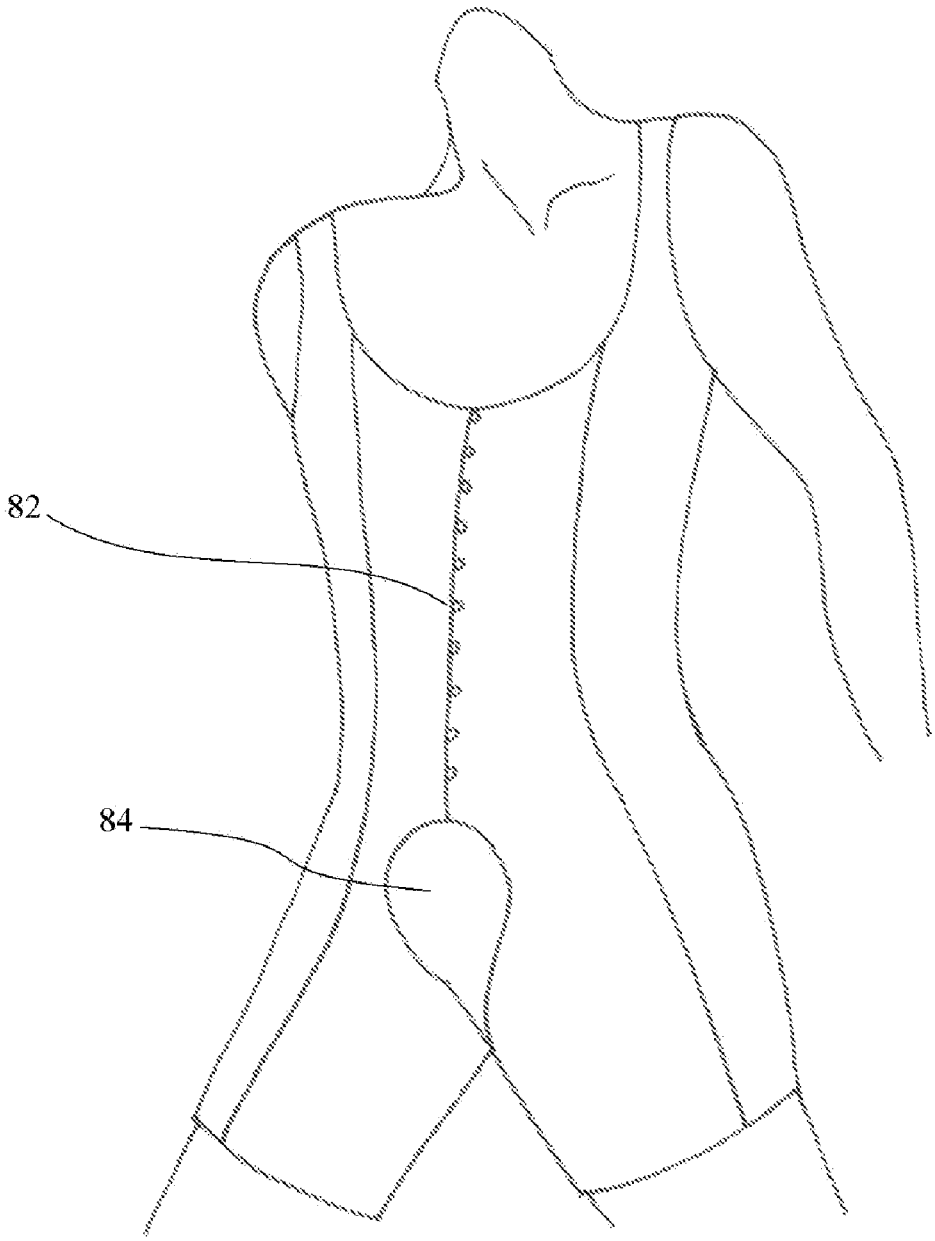
FIG. 9 is a diagram illustrates a fashion wear according to a fifth embodiment of the present invention.

FIG. 9 is a diagram illustrates a fashion wear according to a fifth embodiment of the present invention. Referring to FIG. 1, the wear appears fashion, and not stereotypical or unwieldy. After wearing the wear, one may immediately have a perfect body curve. Before the wear is made, a golden ratio of a male person's body is outlined by a professional. According to the golden ratio and kinesiology, the wear is made by three-dimensionally forming and combining plates. This wear may be designed and functioned to effectively contract a relaxing abdomen, to sculpture a waist, and to centralize a chest.

The above fashion wear may be a body-shaping wear. The fashion wear may be produced by at least sewing a fabric. The fabric may be sewn by using a silk yarn. The fabric, for example, is shown in FIG. 2 or FIG. 3. FIG. 2 schematically shows a piece of printed cloth according to a first embodiment of the present invention. Referring to FIG. 2, the piece of printed cloth may be produced by a process. The process may include a softening step and a dyeing step. The fabric may have a thickness of about 280 to about 600 den. About 22 to about 56 percent of the fabric may be made of a synthetic and elastic fiber. The fabric is softened in the softening step. The fabric is dyed by a printing technique in the dyeing step. The sequence of the steps, merely for example, does not limit the scope of this invention.

The synthetic and elastic fiber may be lycra. Preferably, about 22 to about 56 percent of the fabric may be made of lycra®/spandex. The fabric, with a thickness of about 280 to about 600 den, has a high elasticity coefficient. This fabric effectively shapes one's body. A fashion wear made of this fabric prevents one's body curve from being changed. Furthermore, the fashion wear may prevent one from eating too much or from relaxing his or her pelvis. This fabric is very elastic, so that it is sewn by using a silk yarn preferably.

Referring to FIG. 9, the fashion wear may have a plurality of dark buttons 82. The fashion wear may further have an opening 84 exposing one's crotch.

The above disclosure provides many different embodiments, or examples, for implementing different features of the invention. Also, specific examples of components, and processes are described to help clarify the invention. These are, of course, merely examples and are not intended to limit the invention from that described in the claims.

While the invention has been particularly shown and described with reference to the preferred embodiment thereof, it will be understood by those skilled in the art that various changes in form and detail may be made therein without departing from the spirit and scope of the invention.

What is claimed is:

1. A swimming wear having a back, a buttocks part and a front produced by a process comprising:

using a first and a second pieces of printed clothes to make the back of the swimming wear;

using a third piece of printed clothes to make the buttocks part of the swimming wear; and using a fourth and a fifth pieces of printed clothes to make the front of the swimming wear, wherein each of the first, second, third, fourth and fifth pieces of printed clothes is produced by a process comprising:

softening a fabric, wherein about 22 to about 56 percent of the fabric is made of a synthetic and elastic fiber, and wherein the fabric has a thickness of about 280 to about 600 den, so that a swimming wear made of the fabric shapes one's body;

dyeing the fabric by a printing technique; and sewing the fabric.

2. The swimming wear of claim 1, wherein the fabric is sewn by using a silk yarn.

* * * * *